United States Patent [19]

Knijpstra

[11] Patent Number: 4,807,869

[45] Date of Patent: Feb. 28, 1989

[54] AMUSEMENT DEVICE HAVING A ROTATABLE, SWIVELLING AND TILTABLE RIGID GONDOLA

[75] Inventor: Hette Knijpstra, Terband, Netherlands

[73] Assignee: Knijpstra Konstruktie B. V., Netherlands

[21] Appl. No.: 6,851

[22] Filed: Jan. 27, 1987

[30] Foreign Application Priority Data

Jan. 28, 1986 [NL] Netherlands ..... 8600190

[51] Int. Cl.[4] ..... A63G 1/08

[52] U.S. Cl. ..... 272/28 R; 272/38; 272/49; 272/50

[58] Field of Search ..... 272/36, 38, 44, 7, 28 R, 272/29, 34, 37, 39, 40, 43, 49, 50, 51, 1 R, 1 C

[56] References Cited

U.S. PATENT DOCUMENTS

| | | | |
|---|---|---|---|
| 2,076,113 | 4/1937 | Bartlett | 272/38 |
| 2,229,966 | 1/1941 | Eyerly | 272/38 |
| 4,643,416 | 2/1987 | Van Der Veen | 272/38 |

FOREIGN PATENT DOCUMENTS

| | | | |
|---|---|---|---|
| 3440728 | 5/1986 | Fed. Rep. of Germany | 272/38 |
| 8500983 | 11/1986 | Netherlands | 272/38 |

*Primary Examiner*—Robert A. Hafer
*Assistant Examiner*—Samuel Rimell
*Attorney, Agent, or Firm*—Griffin, Branigan & Butler

[57] ABSTRACT

An amusement device comprising two supporting columns with a carrier arm mounted on each column by means of a horizontal rotation shaft so as to be drivable for rotation thereon. The two carrier arms are rotatable in substantially parallel planes, each carrier arm extending on either side of the associated rotation shaft, with a counterweight mounted on the one end and a three-dimensional rotation joint mounted on the other end for attachment to one end of the gondola. The arrangement is such that the gondola is carried on each end by a separate carrier arm. The device is characterized by a joint mounted in at least one of the two carrier arms in such a manner that the gondola-carrying arm portion swivels about a shaft perpendicular to the longitudinal direction of the rotation shaft.

7 Claims, 3 Drawing Sheets

FIG. 1 (PRIOR ART)
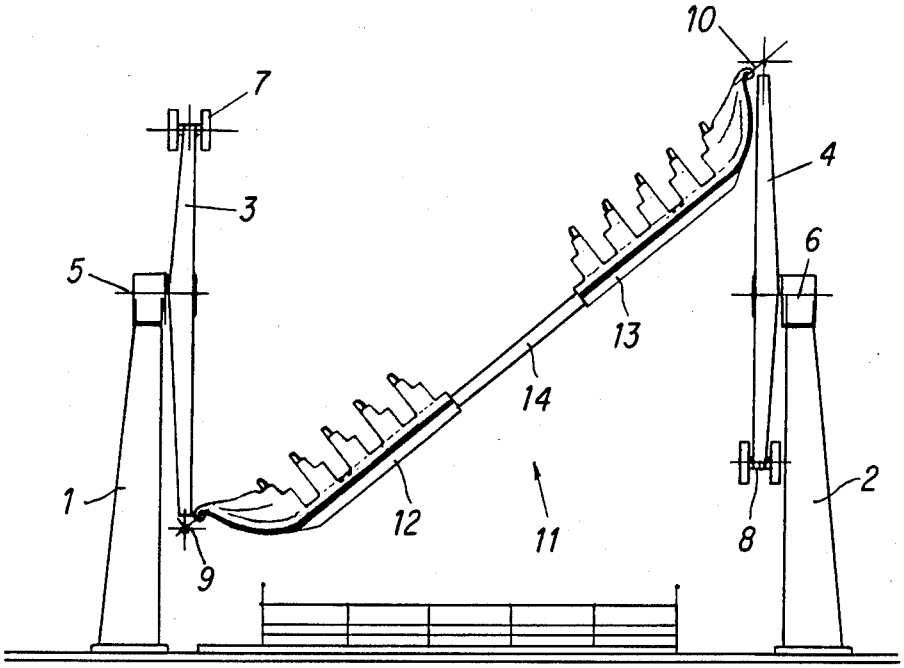
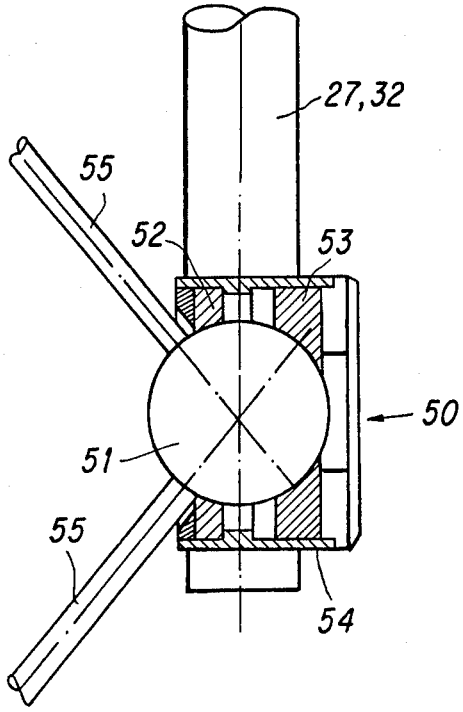
FIG. 5

AMUSEMENT DEVICE HAVING A ROTATABLE, SWIVELLING AND TILTABLE RIGID GONDOLA

This invention relates to an amusement device having two supporting columns with a carrier arm mounted on each supporting column by means of a horizontal rotation shaft for rotating and driving purposes, said two carrier arms being rotatable in substantially parallel planes, each carrier arm extending on either side of the associated rotation shaft with a counterweight mounted on the one end and a three-dimensional rotation joint on the other end for attachment to one end of a gondola in such a manner that the gondola is carried on each end by a separate carrier arm and further comprising adjusting means in such a manner that, on mutually asynchronous drive of the shafts, the gondola is capable of performing any associated combined rotating, swivelling and tilting movement.

A similar device is known and is used in a stationary arrangement in recreation parks. Owing to the possible mutually asynchronous drive of the carrier arms, the gondola is capable of performing spectacular rocking, rotating, swivelling and tilting movements, thereby rousing maximum feelings of excitement in the occupants of the gondola.

In the known devices, the gondola is of two-part design. The two gondola parts can slide towards and away from one another by means of a sliding mechanism connecting the gondola parts. Such a sliding movement is necessary for taking up the variations in distance between the points of attachment of the two carrier arms to the gondola during the various movements of the gondola.

Such a telescopic gondola with a sliding mechanism has a number of drawbacks, the first being that the sliding mechanism is to be mounted in the center of the gondola. However, the gondola center is precisely one of the most heavily loaded parts of the entire construction, so that the sliding mechanism should be heavy and rigid. This requirement applies all the more as, owing to the extension of the gondola, the weight load exerted by the gondola's occupants comes to lie further out from the centre of the gondola. As a result, the sliding mechanism will be loaded still more heavily.

A second drawback connected with the extension of the gondola is that the gondola will get out of balance more quickly by virtue of this extension. Therefore, allowance should be made continuously, when allocating seats, for a well-balanced weight distribution over the gondola. This is highly impractical, since such devices are used mostly by groups, with the group members preferably wishing to sit next to each other.

A third drawback is that the heavy and rigid sliding mechanism should be provided with corresponding guide means. Between the sliding portions and the guide means, there should be sufficient clearance to take up deformations of the gondola. On the other hand, this clearance is highly undesirable, as it greatly increases the chance that the sliding portions will be pulled out of alignment in the guide means. This may result in seizure of the gondola, with disastrous results in that the structure could catastrophically fail. The prior device is not quite reliable in this respect.

A fourth drawback is that objects and even parts of the body of occupants or others may get jammed between the two portions of the gondola as they telescope together. Finally, a fifth drawback is that the prior device, owing to the heavy construction of the gondola, should be of heavy and rigid construction throughout. Such a heavy construction cannot be made both mobile and reliable, but notably requires a solid and stable foundation. Its use remains therefore restricted to stationary arrangements in amusement parks. The known device is not suitable as a mobile funfair attraction.

It is an object of the present invention to remove the above drawbacks.

To this end, a device according to the present invention is characterized in that the adjusting means comprises a joint mounted in at least one of the carrier arms in such a manner that the gondola-carrying arm portion is pivotal about an axis perpendicular to the longitudinal direction of the rotation shaft.

Some embodiments of the invention will now be described, by way of example, with reference to the accompanying drawings, in which:

FIG. 1 is a side view of a known machine;

Figure 4B:
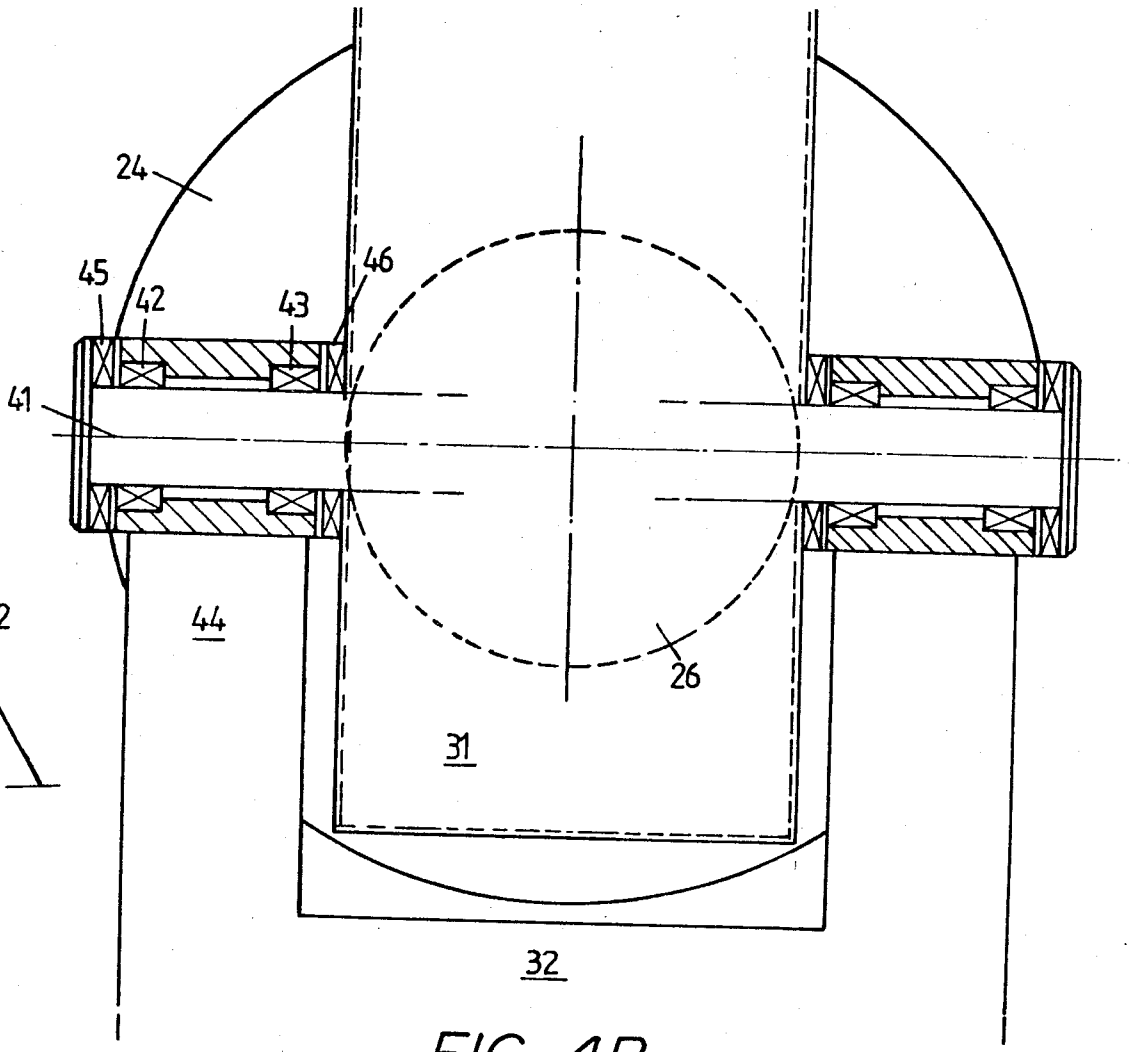
Figure 4A:
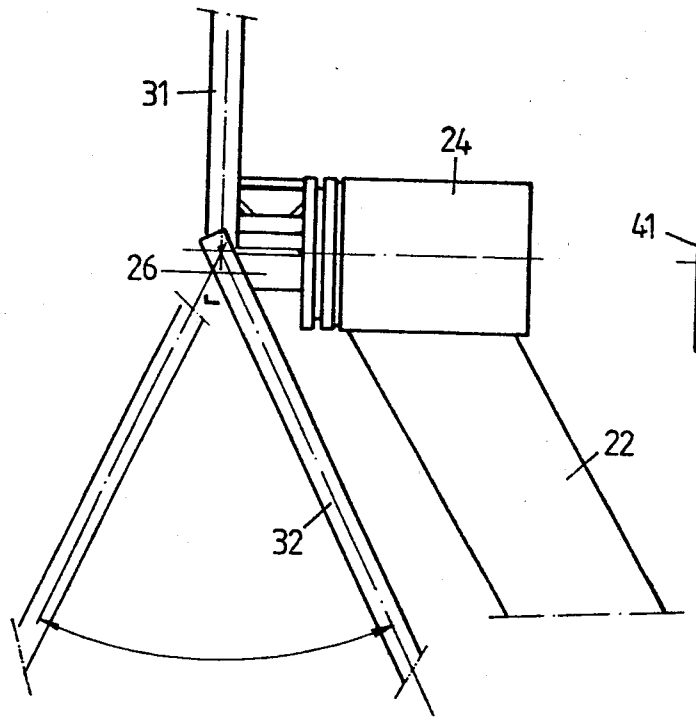

FIG. 4*a* diagrammatically shows a joint in a carrier arm;

FIG. 4*b* is a part-sectional detail view of the joint of FIG. 4*a* and

FIG. 5 shows a ball joint for attachment of the gondola to a carrier arm.

The known machine shown in FIG. 1 comprises two columns 1,2 with a carrier arm 3,4 mounted on each column. The two carrier arms 3,4 are mounted for rotation on the columns through shaft 5,6. Said shafts 5,6 may be driven for example mutually asynchronously. The two arms 3,4 are provided on one end with a counterweight 7,8. The other end of the arms 3,4 is connected to one end of the gondola 11 by means of joints 9,10. Gondola 11 comprises two portions 12,13 interconnected through a sliding mechanism 14. This construction allows the gondola to perform within certain limits random rotating, swivelling and tilting movements in a cylindrical, three-dimensional space defined by the carrier arms 3,4 during rotation.

Figure 2:
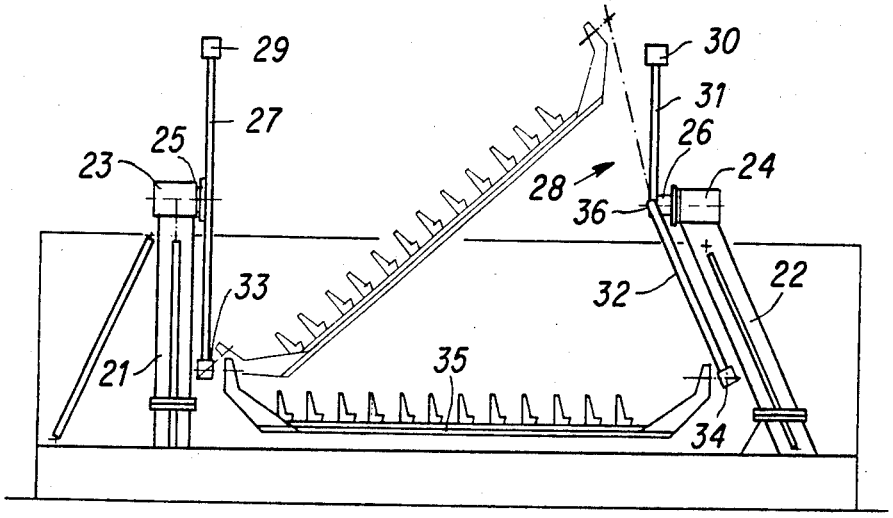
FIG. 2 is a side view of an embodiment of the present invention.

The embodiment of a device according to the present invention shown in FIG. 2 also has two columns 21,22. Column 22 is arranged at an acute angle to the connecting line between the bases of the two columns. On top of the two columns are mounted drive motors 23,24 e.g. electric motors, which are adapted to drive horizontal shafts 25,26. Mounted on said shafts are carrier arms 27,28 each being provided on one end with a counterweight 29,30. Carrier arm 27 is rigid in this case, whereas carrier arm 28 has a joint 36, mounted at the level of rotation shaft 26, is designed in such a manner that the portion 31 of the carrier arm provided with the counterweight is rotatable in a stationary plane substantially parallel to the plane of rotation of carrier arm 27. However, portion 32 of the carrier arm 28 which jointly with one end of carrier arm 27 carries a gondola 35, is pivotal about an axis defined by joint 36, the axis being perpendicular to the rotation of shaft 26. Gondola 35 is connected to carrier arms 27,28 through three-dimensional joints 33,34.

With a mutually synchronous drive of the two motors 23,24, the two carrier arms will swing or rotate about rotation shafts 25,26 from the step-in position of the gondola in FIG. 2 (shown in heavy lines) in a parallel and in-phase relationship, i.e. the gondola 35 suspended between the carrier arms will proceed to swing or rotate with the top surface of the gondola remaining horizontal.

Figure 3:
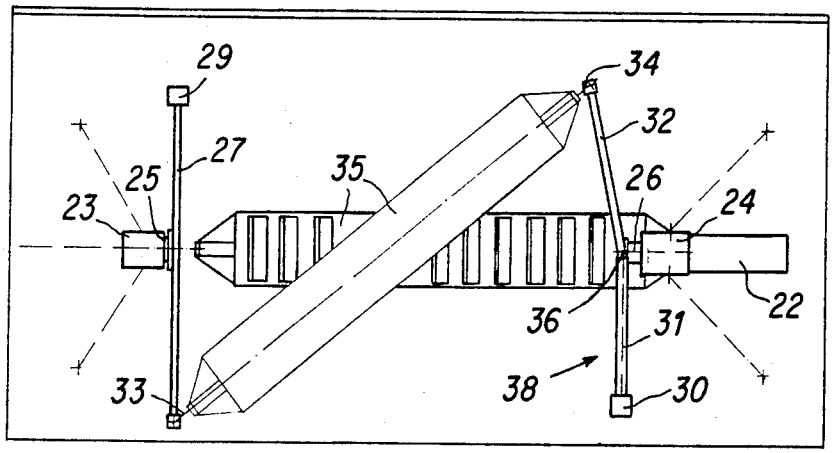
FIG. 3 is a top view of the apparatus of FIG. 2 with 180° phase difference.

When the two motors rotate mutually asynchronously the carrier arms will get out-of-phase with one another, i.e. the gondola 35 suspended between the carrier arms will proceed to swing or rotate with the top surface of the gondola not remaining horizontal. Depending upon the control of the two motors and within certain limits the gondola between the carrier arms can be caused to perform any combined swinging, rotating, swivelling and tilting movement. The pivoting arm portion 32 ensures in that case that no differences in distance occur between the two attachments of the carrier arms to the gondola. A specific situation wherein the pivoting arm 28 has rotated through 180° is shown in thin lines in FIG. 2. The gondola then is at an acute angle to the horizontal. Another instantaneous situation is shown, also in thin lines in FIG. 3. In this case, the two shafts have rotated through 90°, but in opposite directions.

In the step-in position in FIG. 2, the swivelling arm portion 32 is placed at an angle to the vertical. This position defines the outermost swivel position of the arm portion 32. The innermost swivel position of the arm portion 32 occurs when the pivoting arm has rotated from the step-in position through 180°, whereas the carrier arm 27 has remained in the step-in position. By swivelling the arm portion 32, this will in general not be in alignment with the stationary arm portion 31. As a result, the load of the construction becomes more unfavorable and the more so as the acute angle between the swivelling arm portion 32 and the stationary arm portion 31 is larger. The load of the construction can be optimized by making it such that the swivelling arm portion 32 encloses the same acute angle to the stationary arm portion both in the innermost and the outermost swivel position. This acute angle, and hence also the angle which the swivelling arm portion 32 makes with the stationary arm portion 31 in the step-in position, depends upon the other dimensions of the construction, such as the length of the gondola and the length of the carrier arms. In order to be able to place the swivelling arm portion in the step-in position at an angle, it is desirable to place column 22 carrying the pivoting arm 28 also at an angle.

It will be clear for that matter that within the scope of the present invention it is not necessary for the swivelling arm portion and the column to be placed at an angle to the vertical. A swivelling arm portion directed vertically in the step-in position and a vertical column, as in the known machines, will be quite satisfactory.

The adjustment of the gondola position to the position of the carrier arms is entirely taken up with, and enabled by, the combination of the joints between the gondola and the carrier arms and the joint in the carrier arm. The joints between gondola and carrier arms should permit a three-dimensional relative rotation. To this end, universal joints or ball joints are highly suitable. FIG. 5 shows a ball joint 50 which is adjustable, with the ball 51 being rotatable in the bearing parts 52,53. Bearing parts 52,53 are mounted in the bearing housing 54 so as to be slidable and fixable therein. The bearing housing is mounted in either of the carrier arms 27,32. The swivelling range of the ball joint can be adjusted by shifting the bearing parts 52,53 in the bearing housing. Mounted on the ball joint is a mounting arm 55 for the gondola.

FIG. 4 diagrammatically shows an embodiment of a joint for the pivoting carrier arm. Mounted on rotation shaft 26 which is connected to motor 24, is the stationary arm portion 31.

Extending radially through rotation shaft 26 is a pivot pin 41 fixed relative to shaft 26. On said pivot pin 41 is mounted fork portion 44 of the end of the swivelling arm portion 32, by means of bearings 42,43 for taking up radial forces. It will be seen that a similar construction (although not labelled); is mounted at the radially opposite side of shaft 26 and at the other end of pivot pin 41. On shaft 41 are also mounted, on either side of fork portion 44, two bearings 45,46 for taking up radial forces.

It is observed that various modifications of the device described will readily occur to one skilled in the art. For instance, the columns may be placed in off-set relationship and be provided adjacent the foundation with a fixable joint so that the columns can be swung down one along the other on to the foundation. This construction can be moved in a simple manner and is quite well usable in mobile fashion due to this arrangement and partly owing to the relatively light construction, e.g. as mobile funfair attraction. Such modifications are deemed to be within the scope of the present invention.

I claim:

1. An amusement device comprising:

a first horizontal shaft having an end and a first horizontal axis, said first horizontal shaft being rotatable about said first horizontal axis;

a second horizontal shaft having an end and a second horizontal axis, said second horizontal shaft being rotatable about said second horizontal axis;

a first support column for supporting said first horizontal shaft for rotation about said first horizontal axis;

a second support column for supporting said second horizontal shaft for rotation about said second horizontal axis;

a first carrier arm rigidly connected to said end of said first horizontal shaft such that said first carrier arm is rotatable only about said horizontal axis, said first carrier arm comprising a first counterweight portion and a first connecting portion, said first counterweight portion and said first connecting portion extending diametrically opposite one another relative to said first horizontal axis, said first counterweight portion having an end remote from said first horizontal axis, said end of said first counterweight portion remote from said first horizontal axis having a first counterweight attached thereto, said first connecting portion having an end remote from said first horizontal axis;

a second carrier arm, said second carrier arm comprising a second counterweight portion and a second connecting portion, said second counterweight portion rigidly connected to said end of said second horizontal shaft such that said second counterweight portion is rotatable only about said second horizontal axis, said second connecting portion disposed diametrically opposite said second counterweight portion relative to said second horizontal axis and being pivotally connected to said end of said second horizontal shaft for pivotal movement about a third axis, said third axis being transverse to said second horizontal axis, said second counterweight portion having an end remote from said second horizontal axis, said end of said second counterweight portion remote from said second horizontal axis having a second counterweight attached thereto, said second connecting portion having an end remote from said second horizontal axis and an end proximate said second horizontal axis;

gondola means, having a first end and a second end, for supporting a plurality of riders, said first end and said second end being a fixed distance apart;

first connecting means for connecting said first end of said gondola means to said end of said first connecting portion remote from said first horizontal axis;

second connecting means for connecting said second end of said gondola means to said end of said second connecting portion remote from said second horizontal axis;

wherein each of said first and second connecting means comprises a three-dimensional rotation joint.

2. The amusement device according to claim 1, wherein said first carrier arm is substantially perpendicular to said first horizontal shaft and said second counterweight portion is substantially perpendicular to said second horizontal shaft.

3. The amusement device according to claim 1, wherein said first support column is disposed substantially vertically, said second support column is disposed at a first acute angle to the vertical and, when said gondola means is in its lowest vertical position, said second connecting portion forms a second acute angle with the vertical, said first acute angle being larger than said second acute angle.

4. The amusement device according to claim 3, wherein said first horizontal axis is aligned with said second horizontal axis and said first support column is closest to said second support column proximate said aligned axes.

5. The amusement device according to claim 1, wherein said pivotal connection of said second connecting portion to said end of said second horizontal shaft comprises a two prong fork formed at said end of said second connecting portion proximate said second horizontal axis, a fixed pivot pin extending radially, along said third axis, relative to said second horizontal axis, through said end of said second horizontal shaft, said two prong fork engaging said fixed pivot pin for rotation thereabout.

6. The amusement device according to claim 5, wherein said prongs of said two-prong fork are disposed on diametrically opposite sides of said second horizontal shaft relative to said second horizontal axis.

7. The amusement device according to claim 6, wherein said prongs of said two-prong fork are mounted on said fixed pivot pin by means of axial and radial bearings relative to said third axis.

* * * * *